US006394830B1

(12) United States Patent
Huang

(10) Patent No.: US 6,394,830 B1
(45) Date of Patent: May 28, 2002

(54) END CONNECTING STRUCTURE FOR FITTING LIGHTS

(75) Inventor: Peter K. H. Huang, Taipei (TW)

(73) Assignee: Shining Blick Enterprises Co., Ltd. (TW)

( * ) Notice: Subject to any disclaimer, the term of this patent is extended or adjusted under 35 U.S.C. 154(b) by 0 days.

(21) Appl. No.: 09/576,122

(22) Filed: May 22, 2000

(30) Foreign Application Priority Data

Mar. 21, 2000 (TW) ..... 89204504 U

(51) Int. Cl.[7] ..... H01R 4/42
(52) U.S. Cl. ..... 439/282; 362/249
(58) Field of Search ..... 439/877; 362/219, 362/249, 278

(56) References Cited

U.S. PATENT DOCUMENTS 2,563,712 A * 8/1951 Frei et al. ..... 439/279
3,221,290 A * 11/1965 Stark et al. ..... 439/275
4,682,840 A * 7/1987 Lockard ..... 439/877
4,785,567 A * 11/1988 Consiglio ..... 43/17.5
5,156,560 A * 10/1992 Thomas ..... 439/699
5,385,492 A * 1/1995 Stuart ..... 439/877
5,772,454 A * 6/1998 Long, Jr. ..... 439/877
6,217,194 B1 * 4/2001 Huang ..... 362/249

FOREIGN PATENT DOCUMENTS

JP 1-272060 * 10/1989 ..... 439/877

* cited by examiner

*Primary Examiner*—Neil Abrams
*Assistant Examiner*—J. F. Duverne
(74) *Attorney, Agent, or Firm*—Troxell Law Office PLLC

(57) ABSTRACT

An end connecting structure for fitting light which includes a transparent inner pipe having therein positioned conductors and lamp strings and includes an enveloping transparent external layer. The fitting light can be cut into a desired length and leaves conductor sections with desired lengths on one end or both ends thereof in advance after cutting. Male electrical connecting ends or female electrical connecting ends of the amount corresponding to that of the conductors are formed and provided each on one end thereof with a connecting section for connecting with the conductor sections. Thereby, the conductor sections can be connected with the male or female electrical connecting ends by pressing or clamping method to make connection of the male or female electrical connecting ends with the internal conductors firmer and surer. Thus reliability and quality of electric conducting between fitting lights can be elevated.

3 Claims, 5 Drawing Sheets

END CONNECTING STRUCTURE FOR FITTING LIGHTS

BACKGROUND OF THE INVENTION

1. Field of the invention

The present invention is related to an end connecting structure for fitting light, and especially to definite and reliable connecting of male or female electrical connecting insertion ends of a fitting light with the internal conductors of a lamp pipe, thus safety standard with high criticality can be met and elevated.

2. Description of the Prior Art

A fitting light or lighting rope system comprises mainly lamp strings having light emitting or flashing function in a flexible and transparent pipe. It is advantageous in providing a unique decorative effect by light emitting and flashing of a lot of lamp bulbs through a transparent pipe. With the flexible structure which is plastic, the fitting light can be used in various fields for decoration with various patterns. For example, it can be hung on a surface of a building, or can be wrapped on a broad wall with a given pattern to form a marvelous and attractive large light emitting or flashing pattern.

In using such a fitting light, it can have any of various decorative patterns in pursuance of designed patterns or requirement of customers. Hence in manufacturing in factories, fitting lights are all in rolled form. A user buying a fitting light in rolled form can make cutting according to indicative marks to obtain desired lengths and then the lengths are taken for connection.

FIG. 1 shows a kind of internal structure of such a conventional fitting light 10 which is shaped to form a transparent inner pipe 11 of suitable diameter firstly in a factory, the transparent inner pipe 11 is shaped and synchronically makes positioning of two conductors 12, 13 mutually separated in the interior of the transparent inner pipe 11 itself. The conductors 12, 13 are comprised both of a plurality of core wires.

The transparent inner pipe 11 is provided on the periphery thereof with two oppositely arranged guiding grooves 14, 15; and a plurality of diametrical holes 16, 17 of smaller and larger diameters respectively are provided along the transparent inner pipe 11. A plurality of miniature lamp bulbs 18 can be placed in the diametrical holes 17 of larger diameters, two pins 181, 182 of each miniature lamp bulb 18 can be placed in the diametrical holes 16 of smaller diameters, and then are processed (such as by welding) to connect and complete a desired internal lamp string. The core wires of the ends of the conductors 12, 13 can be extended outwardly to electrically connect with the lamp string to get an electric conducting state. The necessitate transparent inner pipe 11 of such a combination can be further enveloped with another transparent external layer 100 by ejection molding to complete the entire fitting light.

A connecting member 19 is provided with and makes positioning of two metallic insertion pieces 191, 192 integrally formed therewith by molding and mutually separated in alignment with the two conductors 12, 13. These metallic insertion pieces 191, 192 are provided respectively with insertion ends 193, 194 on one side of the connecting member 19, and are provided correspondingly with a pair of male or female electrical connecting ends 195, 196 on the other side of the connecting member 19. In this conventional technique structure, the insertion ends 193, 194 on the connecting member 19 are in alignment with and accept insertion of the two conductors 12, 13 with the core wires to build electrical connecting. When the male or female electrical connecting ends 195, 196 are electrically connected, the internal lamp string is wholly lightened and flashes.

The conventional connecting structure for the ends of conductors of a fitting light has its disadvantage residing in that, when a roll of fitting light is cut to get a required length, a worker or a consumer does the work of alignment for connecting of the insertion ends 193, 194 on the connecting member 19 with the two conductors 12, 13 with manpower, assembling is slow and inconvenient. And the insertion ends 193, 194 are often unable to accurately insert respectively into the conductors 12, 13 concentrically, sometimes, deviation in insertion may result incomplete connecting or may result breakage of some thin wall areas 121, 131 of the transparent inner pipe due to extruding. Such connecting structure for the ends of conductors of a fitting light may result undesired and unexpected electrical conducting state. A long and distantly connected fitting light may come into a danger state with overly high electric resistance or abnormal temperature raising by long period electrical conducting, and thereby is uneasy to meet the severer requirement of safety standard.

SUMMARY OF THE INVENTION

The object of the present invention is to provide an end connecting structure for fitting light. When the transparent inner pipe of the fitting light is formed, the conductors simultaneously positioned in the pipe can be processed to leave a desired length each. While the male or female electrical connecting ends can be formed by pressing or turning in mating with the above stated conductors with desired lengths in advance, thus the male or female electrical connecting ends are provided each with a connecting section for connecting with the conductors prepared. Thereby, the male or female electrical connecting ends of the fitting light can be stably and firmly connected with the conductors in the fitting light by pressing of clamping method. And the quality and reliability of electrical connection of them can be assured to meet the severe requirement of safety standard.

The present invention will be apparent in its novelty and features after reading the detailed description of the preferred embodiment thereof in reference to the accompanying drawings.

DETAILED DESCRIPTION OF THE PREFERRED EMBODIMENT

Figure 1:
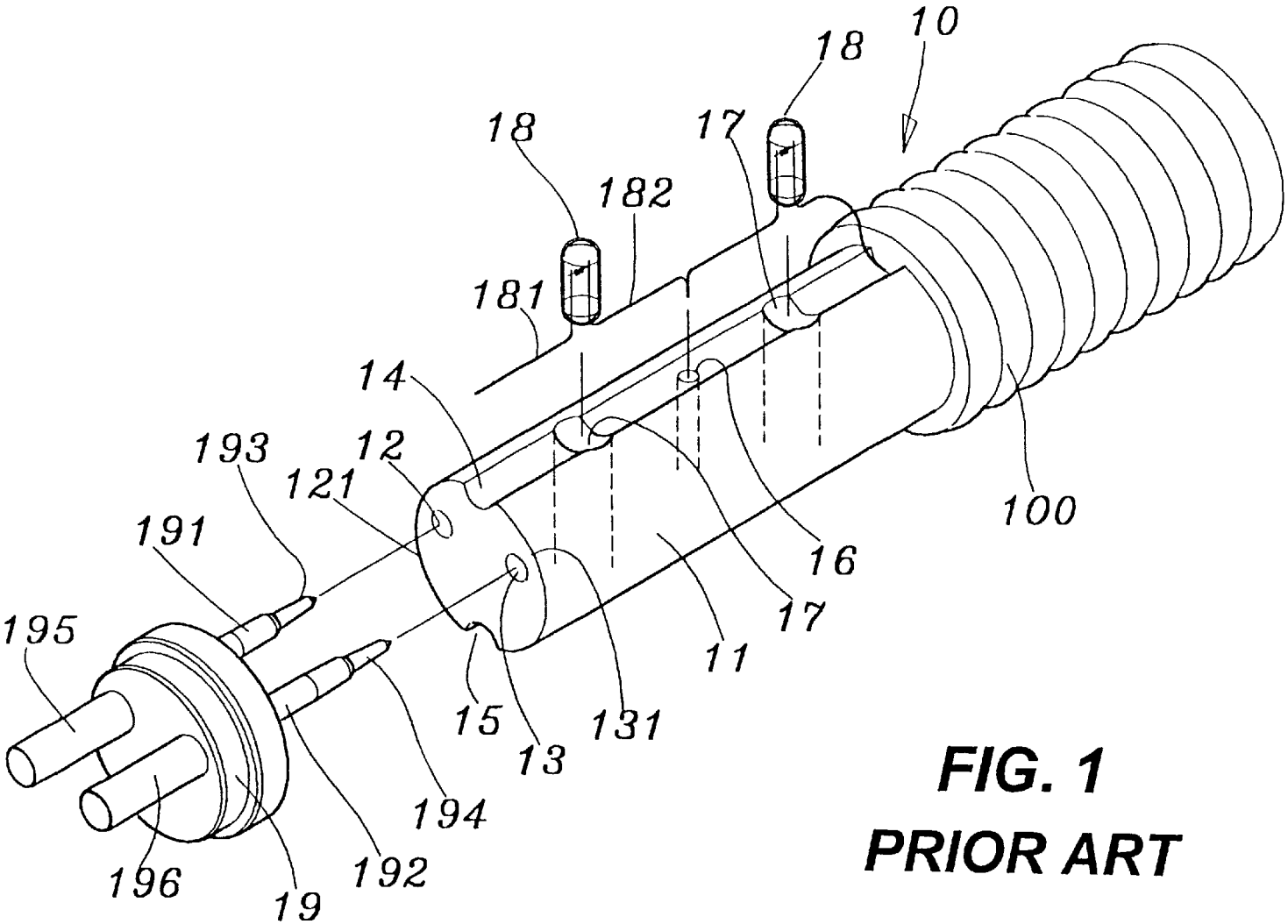
FIG. 1 PRIOR ART
FIG. 1 is an exploded perspective view showing the internal structure of a conventional fitting light.
Figure 2:
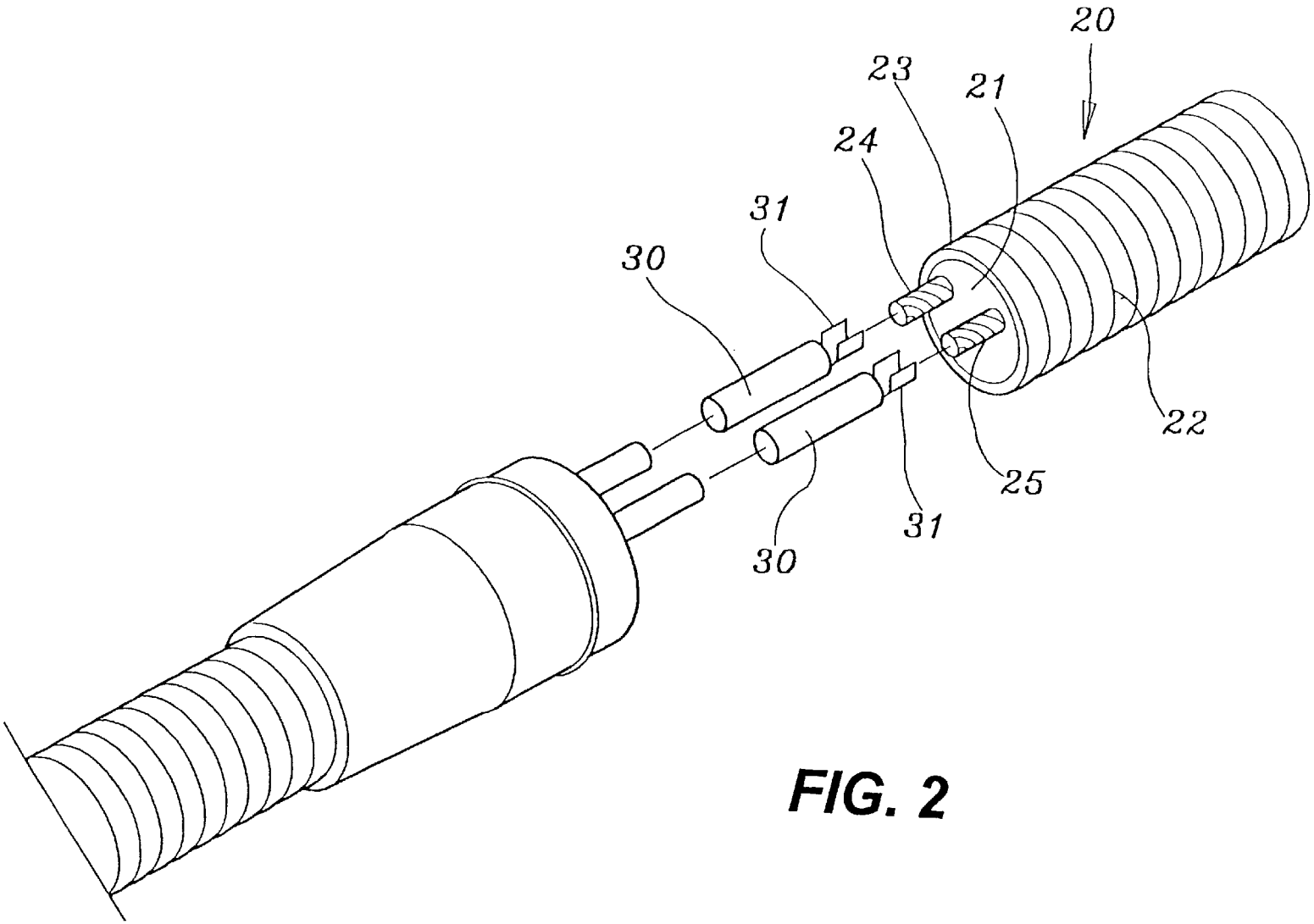
FIG. 2 is an exploded perspective view showing connection of a preferred embodiment of the present invention.

Referring to FIG. 2, in the fitting light 20 shown in the drawing, there are a transparent inner pipe 21 and an enveloping transparent external layer 22 made by ejection molding. The transparent inner pipe 21 is structurally the same as that of the above stated conventional fitting light. In the present invention, when the fitting light 20 is cut to get a desired length, the conductor sections 24, 25 with desired lengths are provided on one end or both ends 23 in advance. These conductor sections 24, 25 with desired lengths are by all means formed from extending of the conductors formed and positioned inside of the transparent inner pipe 21.

Male electrical connecting ends (or female electrical connecting ends) 20 are each provided on one end thereof with a connecting section 31 for connecting with the conductor sections 24, 25. Thereby the conductor sections 24, 25 can be integrally connected therewith by pressing or clamping method with a machine or a simple tool (such as a pair of pincers).

Figures 3A, 3B, 3C:
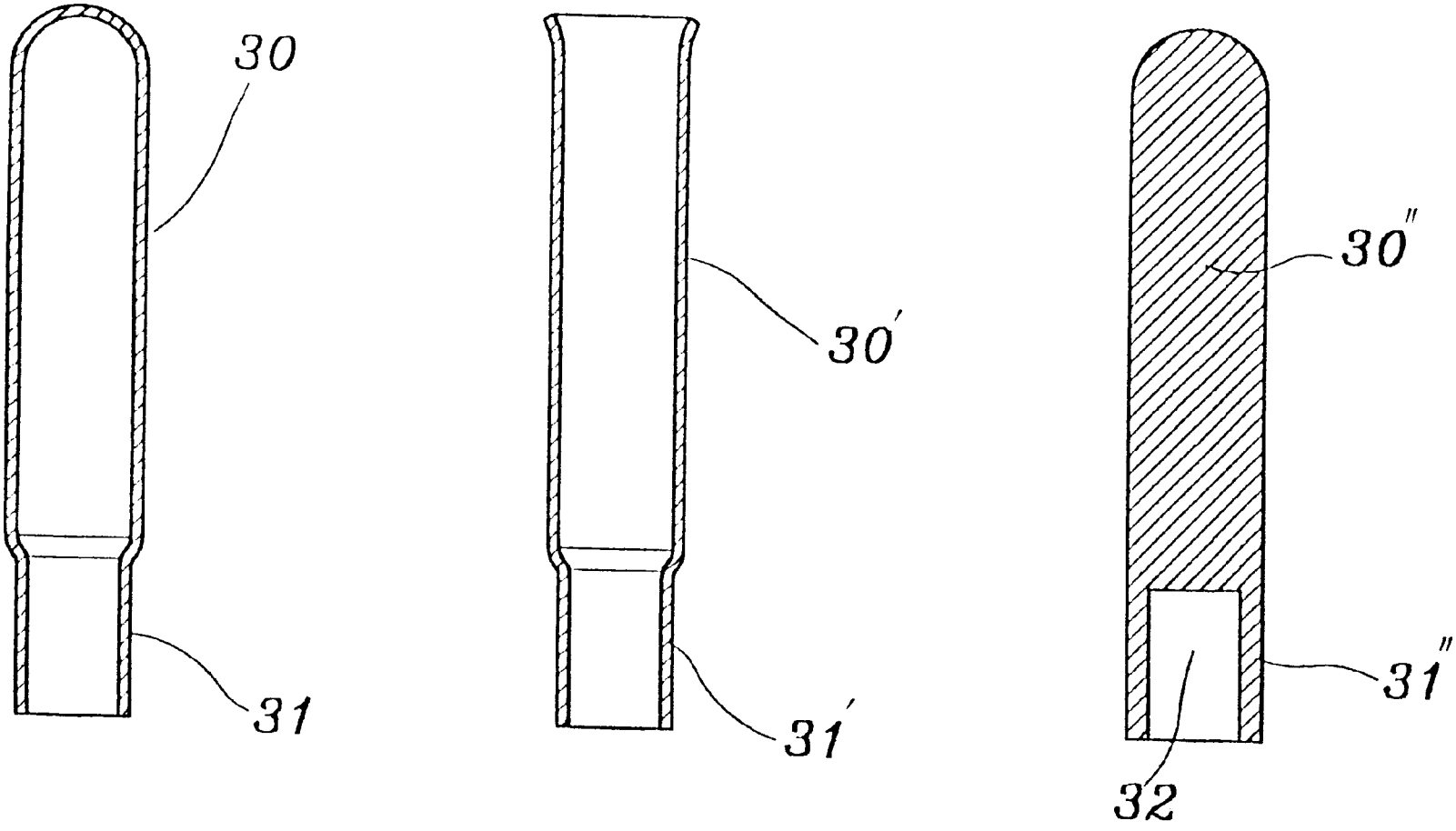
FIGS. 3A–3C show a plurality of embodiments of the connecting ends shown in FIG. .2.

As shown in FIG. 2 and FIGS. 3A and 3B, the connecting sections 31, 31' of the male or female electrical connecting ends 30, 30' can each be formed into a U shaped cross-section by pressing process in advance. So that when the conductor sections 24, 25 are placed in the connection sections 31, 31', they can be subseqentially pressed together on a lathe, or can be clamped together with a simple tool by a consumer. In addition to the above stated pressing process in processing the male or female electrical connecting ends 30, 30', in another embodiment shown in FIG. 3C, the male or female electrical connecting ends 30" can also be turned to get an inner hole 32 with a suitable depth from solid material to form the desired connection sections 31".

Figure 4:
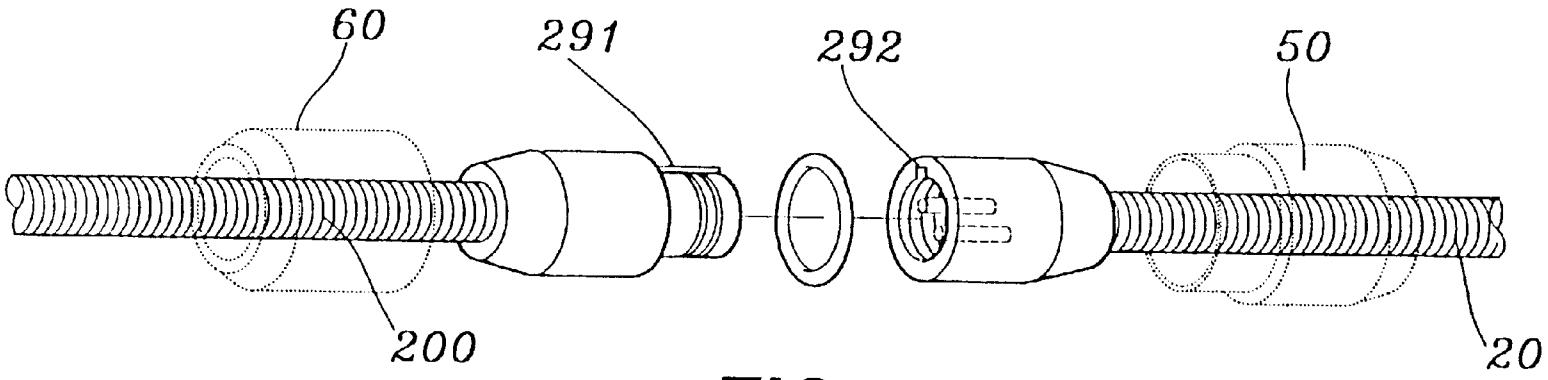
FIG. 4 is an exploded perspective view showing the male or female electrical connecting ends after two external sleeves shown in FIG. 2 is provided but before connection.
Figure 5:
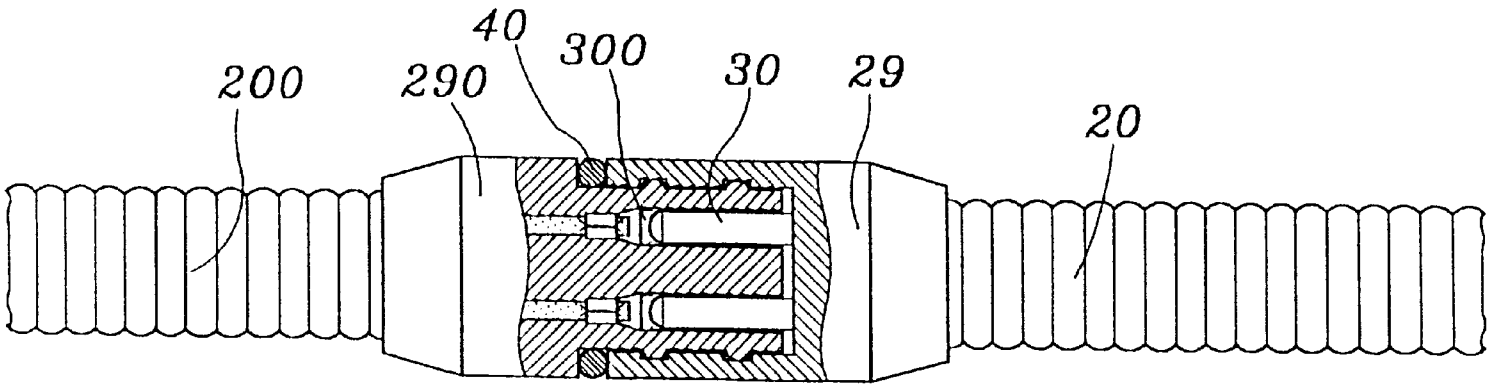
FIG. 5 is a sectional elevation view showing connection of the members as shown in FIG. 4.

As shown in FIGS. 4 and 5, the above stated fitting light 20 having been assembled with the male or female electrical connecting ends 30 can be further ejection molded on one end thereof to form a male or female electrical connecting end portion. In the embodiment shown in the drawings, the fitting light 20 having been assembled with the male connecting end 30 and another fitting light 200 having been assembled with the female electrical connecting end 300 can be respectively formed and enveloped through injection molding by a female electrical connecting end portion 29 and a male electrical connecting end portion 290. So that the ends of the fitting lights 20, 200 can be assembled and gotten a conducting state by means of the male and female electrical connecting ends 30, 300. And the female electrical connecting end portion 29 and the male electrical connecting end portion 290 can be provided with a leak-proof gasket 40 therebetween.

In order to assure accurate direction of inserting, the female electrical connecting end portion 29 and the male electrical connecting end portion 290 can be provided at the joint thereof respectively with an axial groove 292 and a guide rail 291 mating with each other. So that the male and female electrical connecting ends 30, 300 inside of them can be connected with each other by insertion.

In order to make firm and fast connecting of the female electrical connecting end portion 29 and the male electrical connecting end portion 290, the female electrical connecting end portion 29 and the male electrical connecting end portion 290 can be provided nearby themselves with a male sleeve 50 and a female sleeve 60 respectively, so that the two fitting lights 20, 200 can be fast and tightly combined with each other by means of such joint structure.

Figure 6:
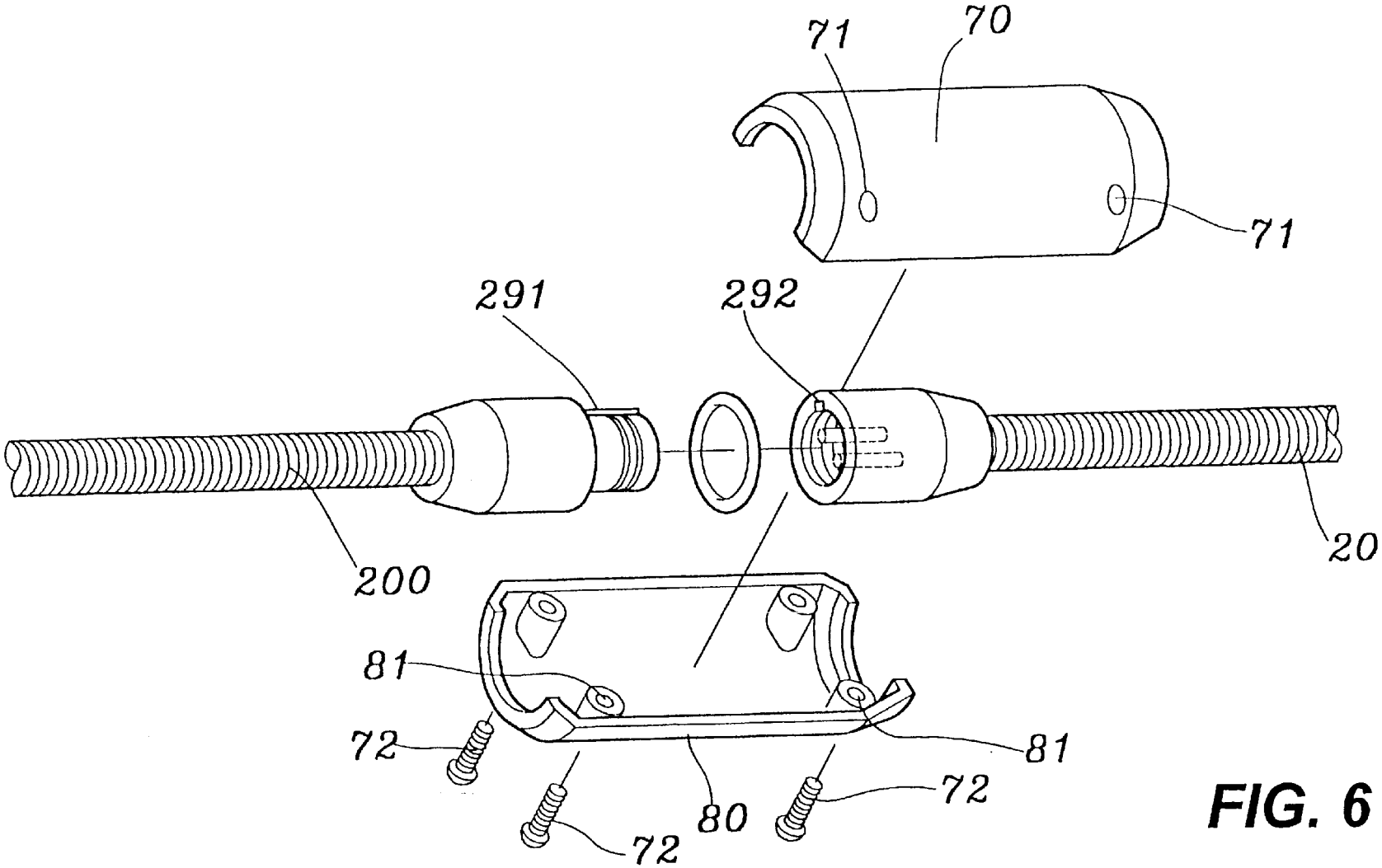
FIG. 6 is an exploded perspective view analytically showing another connecting joint of the present invention.

In another embodiment shown in FIG. 6, the present invention can also use a joint structure formed from two half cylindrical pieces 70, 80 provided each with four corner through holes 71, 81 respectively, bolts 72 can be used to extend through the corner through holes 71, 81 to fixedly combine the fitting lights 20, 200.

The present invention solves the disadvantageous problem residing in inserting the insertion ends of the connecting member into the conductors by manpower after cutting to get a fitting light as in the conventional cases. The present invention not only has the advantage of easiness in connecting with the conductors, but also renders the joint structure firmer and more reliable in meeting the high safety standard.

My invention is to be construed as including all modifications and variations falling within the scope of the appended claims.

What is claimed is:

1. A fitting light assembly comprising:

a fitting light cuttable into a desired length and having a transparent inner pipe within a transparent external layer and surrounding a plurality of electrical conductors and lamp strings, each electrical conductor having an exposed part extending outwardly from an end of the inner pipe; and, an end connecting structure including elongated, cylindrical electrical connecting ends attached to the exposed parts of the electrical conductors so as to be located exteriorly of the transparent inner pipe, each connecting end having a first end portion forming an electrical connector and an opposite, second end forming a hollow connecting section receiving the exposed part of the associated electrical conductor therein, the hollow connecting section being clamped to the associated electrical conductor such that the elongated connecting end extends in a same direction as the associated electrical conductor, wherein each connecting end on the first end portion has a diameter greater than the hollow connecting section on the opposite, second end portion.

2. The fitting light assembly of claim 1 wherein the first end portion of at least one of the electrical connecting ends comprises a male electrical connector.

3. The fitting light assembly of claim 1 wherein the first end portion of at least one of the electrical connecting ends comprises a female electrical connector.

* * * * *